US005551832A

United States Patent [19]

Kelly

[11] Patent Number: 5,551,832

[45] Date of Patent: Sep. 3, 1996

[54] METHOD AND APPARATUS FOR STACKING GOLF BALLS

[76] Inventor: Gregory J. Kelly, 1900D Riverwood La., Roswell, Ga. 30075

[21] Appl. No.: 514,823

[22] Filed: Aug. 14, 1995

[51] Int. Cl.[6] ..... B65B 35/50; A47F 7/00

[52] U.S. Cl. ..... 414/788; 414/786; 206/315.9; 206/499; 211/14; 473/131; 473/409

[58] Field of Search ..... 414/786, 788, 414/788.9, 799, 922; 273/32 D, 201; 211/14; 206/315.9, 499, 563; 53/255, 397, 473

[56] References Cited

U.S. PATENT DOCUMENTS 1,201,441 10/1916 Clinger ..... 211/14
3,139,185 6/1964 Wentz ..... 211/14
3,302,843 2/1967 Sheehan ..... 206/315.9
4,103,773 8/1978 Haber ..... 211/14
4,892,197 1/1990 Slattery et al. ..... 211/14
5,381,895 1/1995 Thomsen ..... 211/14

*Primary Examiner*—Karen Merritt
*Assistant Examiner*—Douglas Hess
*Attorney, Agent, or Firm*—Jones & Askew

[57] ABSTRACT

A method and apparatus for stacking golf balls in an aesthetically pleasing manner includes the use of a invertible form having a cavity therein. By placing golf balls within the cavity, the form may be inverted and the balls therein allowed to assume a stacked configuration atop a supporting base, which can be maintained after the form is lifted upwardly and away from the stack/base combination.

7 Claims, 2 Drawing Sheets

METHOD AND APPARATUS FOR STACKING GOLF BALLS

TECHNICAL FIELD

The present invention relates in general to golfing, and particularly relates to a method and apparatus for stacking golf balls in an aesthetically pleasing manner such that said golf balls may be selectively removed from a pyramidic golf ball stack without significantly disrupting the stack.

BACKGROUND OF THE INVENTION

The present invention relates to golf balls, and particularly relates to a method and apparatus for grouping and stacking golf balls in an aesthetically pleasing manner to facilitate their selective removal therefrom.

In the field of golfing, it is often desirable to provide one or more stacks of golf balls in order to allow the golf balls to be selectively removed from the stack. For example, at golf driving ranges, it is often desired to provide a group of such golf balls at each booth, in order to allow a golfer practicing his or her swing to repeatedly pick a golf ball from the group of balls, place the ball on a tee, and hit it.

It is presently known to group such golf balls by the use of a wire or other suitable basket, with the balls simply being placed in a relatively unorganized manner within the basket, and either dumped or manually removed one-by-one therefrom.

It is also known to arrange such golf balls in groups by hand-stacking them into "pyramids", with a person manually stacking golf balls upon a suitable base and stacking additional golf balls level-by-level upon the previously-positioned level of golf balls. This method may include the use of a triangle-shaped base having holes pre-drilled therein to assist in the placement of the first level of golf balls. Although such a pyramid presentation provides an aesthetically-pleasing presentation of golf balls, it can become somewhat time-consuming to achieve due to its labor-intensive nature.

Therefore, it may be seen that there is a need in the art to provide a method and apparatus for quickly and easily stacking golf balls in an aesthetically pleasing manner, which allows for such stacking without excessive labor use.

SUMMARY OF THE INVENTION

The present invention overcomes deficiencies in the prior art by providing a method and apparatus for stacking golf balls in an aesthetically pleasing manner, which is cost-and labor-efficient to use and operate.

Generally described, the present invention relates to a method of placing a plurality of golf balls within an inverted form, placing an inverted base atop said inverted form, inverting the entire assembly such that the plurality of golf balls is stacked upon the now-upright base, and withdrawing the now-upright form such that a pyramidic stack of golf bails is left remaining atop the base. The present invention also relates to an apparatus for facilitating the above method.

Therefore, it is an object of the present invention to provide a method and apparatus for stacking golf balls in an aesthetically pleasing manner.

It is a further object of the present invention to provide a method and apparatus for stacking golf balls which is simple in operation.

It is a further object of the present invention to provide a method and apparatus for stacking golf balls which is cost-effective in operation.

It is a further object of the present invention to provide an apparatus for stacking golf balls which is cost-effective to manufacture.

Other objects, features, and advantages of the present invention will become apparent upon reading the following detailed description of the preferred embodiment of the invention when taken in conjunction with the drawing and the appended claims.

DETAILED DESCRIPTION OF THE PREFERRED EMBODIMENT

Figure 1:
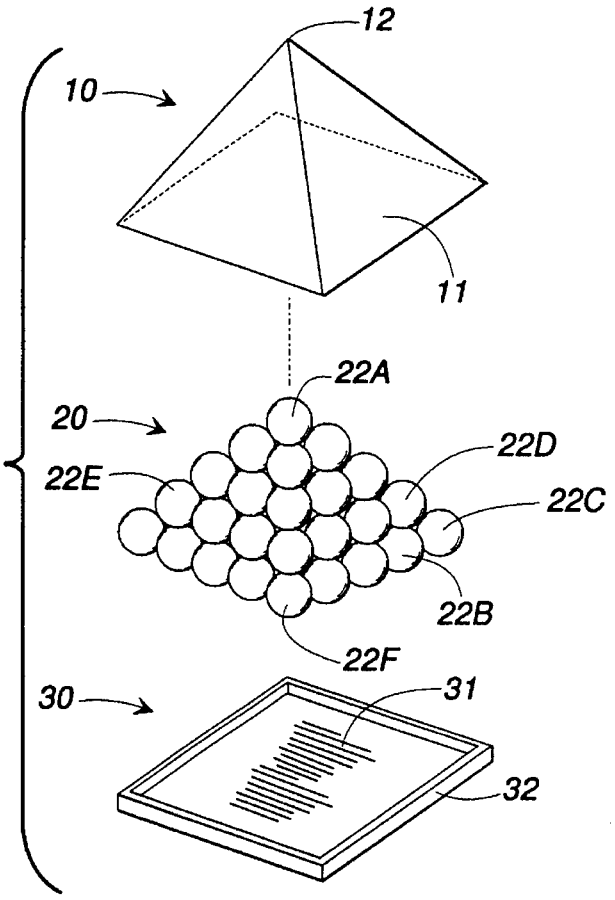
FIG. 1 is an exploded illustrative pictorial view of a stacking form 10 (with a handle not shown), a group 20 of stacked balls, and a base 30.
Figure 2:
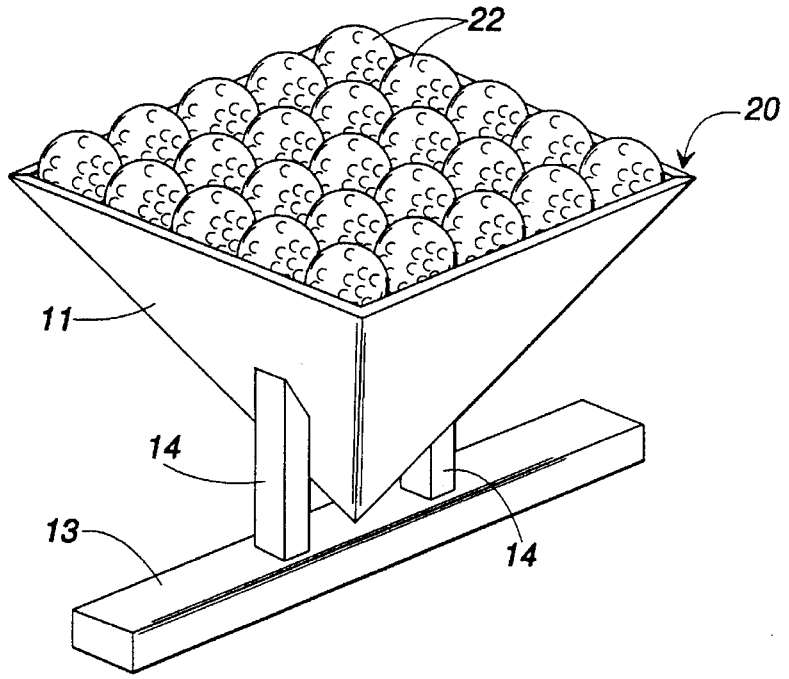
FIG. 2 is a pictorial view of a stacking form according to the present invention (with a handle 13 shown) with a group of golf balls placed therein.
Figure 3:
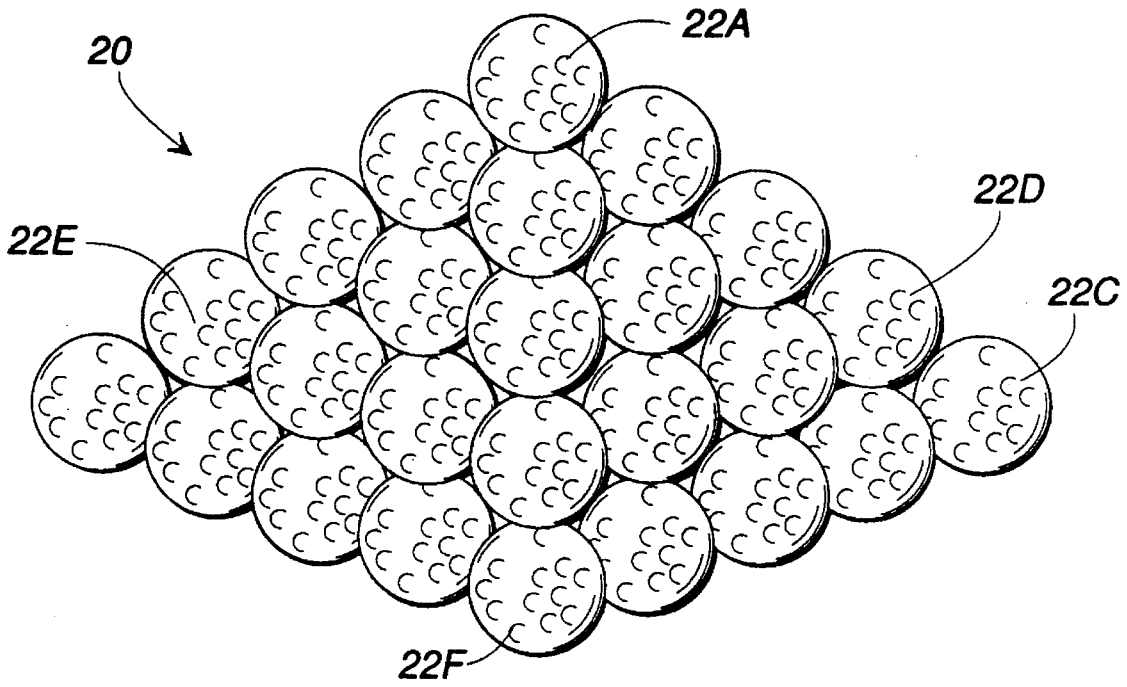
FIG. 3 illustrates a stack of golf balls provided under the present invention, with a topmost "peak" ball designated as 22A, certain golf balls on the lowest, "first" level designated as 22F and 22C, and golf balls on the "second" level designated at 22E and 22D.

Reference is first generally made to FIGS. 1, 2, and 3, in which like numerals designate like elements throughout the illustrated views.

FIG. 1 illustrates the cooperation of an invertible forming member 10, a stack of golf balls 20, and a supporting base member 30. As will be discussed in further detail, golf balls placed within the invertible forming member 10 can be inverted along with the forming member such that they rest upon the supporting base 30. Preferably, the balls remain in the stacked group 20 shown in FIG. 1 even after the form 10 is then withdrawn upwardly and is no longer in contact with the group 20 of golf balls.

As shown in FIG. 1, the base 30 includes a planar member 31 having a peripheral ledge 31 attached thereto configured to provide lateral peripheral support to the lowermost level of golf balls.

Referring now to FIG. 2, it may be seen that the forming member 20 includes four side wall sections 11, which are fastened together by corner brackets (not shown) such as known in the art. The side wall sections 11 may be of plywood or other suitable material. A wooden handle member 13 is rigidly attached relative to the side walls by wooden support posts 14. As shown in FIG. 2, a group of golf balls such as 22 are shown within forming member 20 while in its "forming" orientation. In this orientation, the forming member 20 has an upwardly-directed forming cavity which is configured to accept the plurality of golf balls and to encourage the golf balls into the grouping shown in FIG. 2. Such a grouping is the same as the golf ball grouping shown in FIGS. 1 and 3, except that instead of the peak of the pyramidic grouping being pointed upwardly as shown in FIGS. 1 and 3, the peak is pointed downward in the orientation shown in FIG. 2.

A stacking method according to the present invention is now described. The forming member 20 is oriented as shown in FIG. 2, with its ball-receiving cavity being directed generally upwardly. The forming member 20 may be maintained in a relatively stable state by placing the outward flat face of the handle member 13 in planar contact with a substantially horizontal supporting surface (not shown). A plurality of golf balls 22 are then placed within the upwardly-disposed cavity, such that they are situated within the forming member 20 such as shown in FIG. 2.

It should be understood that when the golf balls are being placed within the forming member 20, it may be necessary for the human operator to guide balls somewhat towards their desired locations. However, it will be understood that the forming member 10 provides the final determination as to the shape of the golf ball group.

After the golf balls 22 are situated acceptably, the human operator then places a base (such as 30 in FIG. 1) atop the golf ball group, such that the golf ball group is substantially enclosed by the form/base combination. The form 10, balls 22, and base 30 are then inverted together as a group.

Upon such an inversion, a base layer of golf balls then is in contact with the lower base 30, with the outermost golf balls of the base (or "first") layer of balls also being laterally contained by the upwardly-projecting peripheral edge member 32. Upon withdrawal of the forming member 10, a pyramidically-shaped golf ball stack such as shown in FIG. 3 is provided (atop the base 30) for selective removal as needed.

Alternatives

It may be understood that although FIGS. 1, 2, and 3 illustrate a four-sided forming member configuration, other configurations may also be provided under the present invention. For example, three-sided, five-sided, or other multiple-sided form members may be provided under the present invention, provided they facilitate a suitably stable stacked configuration upon inversion.

In the embodiment illustrated in FIG. 3, the uppermost level of balls in the stacked configuration is one in number. The second level is four in number (2×2). The third level includes nine golf balls (3×3). The fourth level includes 16 golf balls (4×4), and the fifth level is 25 (5×5) in number. However, it should be understood that additional levels may be included, with a preferred embodiment including seven levels, with the lowermost level having 49 (7×7) balls therein.

It should also be understood that although the forming member 20 embodiment shown in FIG. 2 is made mostly of wood with metal fasteners, other suitable materials such as plastic or fiberglass may also be used without departing from the spirit and scope of the present invention.

Conclusion

While this invention has been described in specific detail with reference to the disclosed embodiments, it will be understood that many variations and modifications may be effected within the spirit and scope of the invention as described in the appended claims.

What is claimed is:

1. A method for stacking golf balls, comprising the steps of:

a) placing a plurality of golf balls into an upwardly-directed interior cavity of a stack forming member such that a first golf ball is above a second golf ball and placing a base member atop said stack forming member;

b) inverting said stack forming member and said base member along with said plurality of said golf balls such that said cavity of said stack forming member is directed downwardly and said first golf ball is below said second golf ball and contacts said member; and c) removing said stack forming member such that said first golf ball is below and at least partially supports said second golf ball and said first golf ball is at least partially contained by said base member.

2. The method as claimed in claim 1, wherein in step "c", a pyramidic golf ball stack is provided.

3. The method as claimed in claim 2, wherein said first golf ball is part of a first level of a plurality of golf balls placed within said forming member during step "a", wherein said second golf ball is part of a second level of a plurality of golf balls placed below said first level of golf balls during said step "a".

4. A method for stacking golf balls, comprising the steps of:

a) placing a plurality of golf balls into an upwardly-directed interior cavity of a stack forming member such that a first golf ball is above and at least partially supported by a second golf ball;

b) placing a base member atop said stack forming member such that said stack forming member substantially closes said interior cavity of said stack forming member, and such that said plurality of golf balls is substantially contained by said stack forming member and said base member;

c) inverting said stack forming member, said base member, and said contained golf balls;

d) removing said stack forming member such that said first golf ball is below and at least partially supports said second golf ball.

5. The method as claimed in claim 4, wherein in step "c", a pyramidic golf ball stack is provided.

6. The method as claimed in claim 5, wherein said first golf ball is part of a first level of a plurality of golf balls placed within said forming member during step "a", wherein said second golf ball is part of a second level of a plurality of golf balls placed below said first level of golf balls during said step "a".

7. An apparatus for stacking golf balls, comprising:

a stack forming member defining an open cavity configured for accepting a plurality of golf balls from above when in a first orientation; and a base member configured for substantially enclosing said golf balls within said cavity when said stack forming member is in said first orientation, and configured for supporting said golf balls in a stacked configuration upon the inversion of said golf balls, said forming member, and said base member to a second orientation and subsequent removal of said stack forming member.

* * * * *